US005707178A

United States Patent [19]

Srinivasan

[11] Patent Number: 5,707,178

[45] Date of Patent: Jan. 13, 1998

[54] TENSION BASE FOR TENSION LEG PLATFORM

[76] Inventor: Nagan Srinivasan, 2400 Old South Dr., Suite 2921, Richmond, Tex. 77469

[21] Appl. No.: 561,403

[22] Filed: Nov. 21, 1995

[51] Int. Cl.[6] ..... B63B 35/44; E02B 17/00

[52] U.S. Cl. ..... 405/223.1; 405/227; 405/224

[58] Field of Search ..... 405/224, 223.1, 405/208, 207, 195.1, 205, 204, 227

[56] References Cited

U.S. PATENT DOCUMENTS

| | | | |
|---|---|---|---|
| 3,086,368 | 4/1963 | Popper | 405/224 |
| 3,540,396 | 11/1970 | Horton | 405/223.1 X |
| 3,550,385 | 12/1970 | Lowd et al. | 405/224 X |
| 3,927,535 | 12/1975 | Giblon | 405/224 X |
| 3,982,401 | 9/1976 | Loggins | 405/224 X |
| 4,512,886 | 4/1985 | Hicks et al. | 210/170 |
| 4,674,918 | 6/1987 | Kalpins | 405/224 |
| 4,702,648 | 10/1987 | Stageboe et al. | 405/224 |
| 5,046,896 | 9/1991 | Cole | 405/224 X |

*Primary Examiner*—Dennis L. Taylor
*Attorney, Agent, or Firm*—Kenneth A. Roddy

[57] ABSTRACT

An offshore platform for supporting a platform deck in deep water. A buoyant base is submerged below the water surface and is retained with base tendons to a foundation on the sea floor. The buoyant base is attachable to the mooring tendons of a tension leg vessel positioned above the buoyant base. The buoyant base can be selectively ballasted to control the tension in the base tendons. Additional buoyant bases and connecting tendons can extend the depth of the total structure beyond depths possible with conventional tension leg structure technology. Mooring lines can be connected between the buoyant base and the sea floor to limit lateral movement of the buoyant base. The buoyant base esentially creates a submerged foundation which reduces the required length of a conventional tension leg platform. The tension leg platform can be detached from the buoyant base and moved to another location.

18 Claims, 2 Drawing Sheets

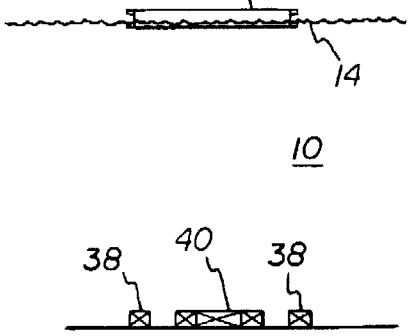
FIG. 3
FIG. 4
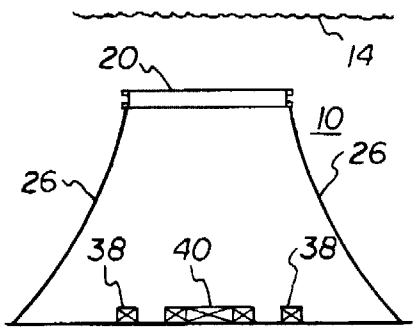
FIG. 5
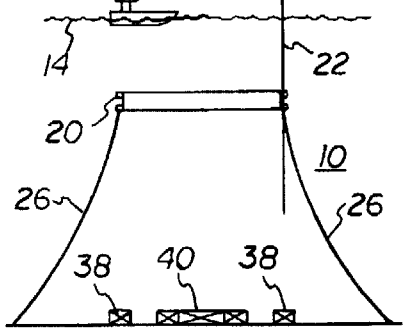
FIG. 6
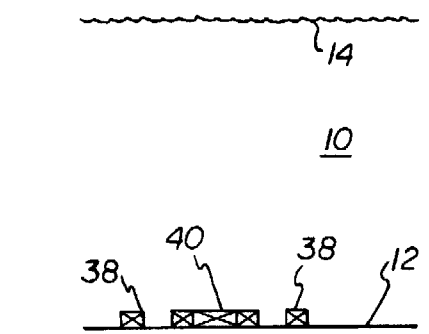
FIG. 7
FIG. 8
FIG. 9
FIG. 10

TENSION BASE FOR TENSION LEG PLATFORM

BACKGROUND OF THE INVENTION

The present invention relates to an apparatus and related method for anchoring a tension leg platform to a foundation attached to the sea floor. More particularly, the present invention relates to a bouyant tension base having tendons attached in tension between the buoyant tension base and the sea floor foundation and to which the tension leg platform vessel is attached by mooring tendons. The buoyant base can be stabilized with mooring lines attached to the sea floor.

Various concepts have been developed to create a drilling and production platform for hydrocarbon production operations in deep water. In deep water operations, platform construction costs significantly affect the overall hydrocarbon field development expense. Tension leg platforms have been designed and contructed in an effort to reduce costs. A conventional tension leg platform comprises a vessel having mooring tendons attached in tension between the vessel and a sea floor foundation. Such platforms are affected by environmental loading forces such as ocean currents, wind, and wave action occuring near the water surface. Conventional tension leg platform technology is described in U.S. Pat. No. 4,784,529 to Hunter (1988), in U.S. Pat. No. 4,848,970 to Hunter et al. (1989), and in U.S. Pat. No. 4,938,632 to Eie (1990).

Conventional tension leg platforms have limitations in deep water. As the water depth increases and the mooring tendon length and weight increases, the vessel must be enlarged to maintain sufficient tension on the mooring tendons. This requirement is undesirable because the larger vessels are more susceptible to environmental loading forces. Additionally, the elasticity of the mooring tendons increases vertical movement and requires greater tension in the mooring tendons. To provide additional tension, the vessel size must be increased.

The limitations on tension leg platforms in deep water have spurred the development of different deep water concepts. One platform concept mounts a conventional platform jacket structure on a floating pontoon. U.S. Pat. No. 5,044,828 to Berner, Jr. et al. (1991) and U.S. Pat. No. 4,895,481 to Pepin-LeHalleur (1990) describe variations of this concept. However, platforms constructed with this concept are adversely affected by the large moment arm rotating the upper platform structure around the submerged float. Such moment exagerates movement of the platform deck and creates the possibility of failure at the connection between the jacket base and tendon.

Another platform concept attempts to reduce differential movement between multiple mooring tendons. In United U.S. Pat. No. 4,740,109 to Horton (1988), multiple mooring tendons were gathered along the center axis of the platform. In U.S. Pat. No. 4,913,238 to Danazcko (1990), a caisson on a semisubmersible vessel moved relative to centralized production tubing. The centralized tubing significantly avoided differential tension typically found in opposing tendons of a tension leg platform.

Another concept known as the "suspended TLP concept" is described as a tension leg platform where the foundation weight is suspended above the sea floor by the surface vessel. This concept requires a dynamic ballasting system for the suspended weight, and the negative buoyancy of the weight requires a larger surface vessel size. This concept is also disadvantaged by relative movement between the vessel and suspended weight caused by environmental loading forces and by the tendon elasticity.

Another platform concept known as the "hybrid compliant platform concept" combines tensioned mooring lines with an internal jacket structure for supporting drilling and production risers. Although this concept is useful for platforms requiring large deck payloads, the concept may not be economical at large water depths because the concept depends on a center jacket combined with stabilizing tension leg tendons.

Accordingly, a need exists for an improved offshore platform that can efficiently support a platform deck in deep water. The platform should be economic to construct and should reliably accommodate environmental loading forces.

SUMMARY OF THE INVENTION

An apparatus and method for anchoring the vessel and mooring tendons of a tension leg platform is disclosed. The apparatus comprises at least two base tendons having lower and upper ends, wherein the lower ends of the base tendons are attached to the foundation. A buoyant base is attached to the upper ends of the base tendons at a selected position below the water surface, and the buoyant base is further attachable to the mooring tendons of the tension leg platform.

In other embodiments of the invention, a pump can be positioned to selectively pump water into or out of the buoyant base, a sensor can detect the quantity of water in the buoyant base, and a control system attached to the sensor and the pump can selectively control the amount of water in the buoyant base. A lower buoyant base can be attached to the lower ends of the base tendons, and at least two lower base tendons can be attached between the lower buoyant base and the foundation.

The method of the invention comprises the steps of positioning a buoyant base above the foundation, of selectively introducing ballast into the buoyant base to lower the buoyant base to a position below the water surface, of attaching the lower end of base tendons to the foundation, of attaching the upper end of the base tendons to the buoyant base, and of attaching the lower end of the tension leg mooring tendons to the buoyant base. In other embodiments of the invention, mooring lines can be attached between the buoyant base and the sea floor, the tension of the base tendons can be controlled by moving water into and out of the buoyant base, and the mooring tendons attached to the tension leg vessel can be detached from the buoyant base to permit removal of the tension leg vessel.

BRIEF DESCRIPTION OF THE DRAWINGS

FIGS. 3–10 illustrate one method of installing a buoyant base in cooperation with a conventional tension leg platform.

DESCRIPTION OF THE PREFERRED EMBODIMENTS

Figure 1:
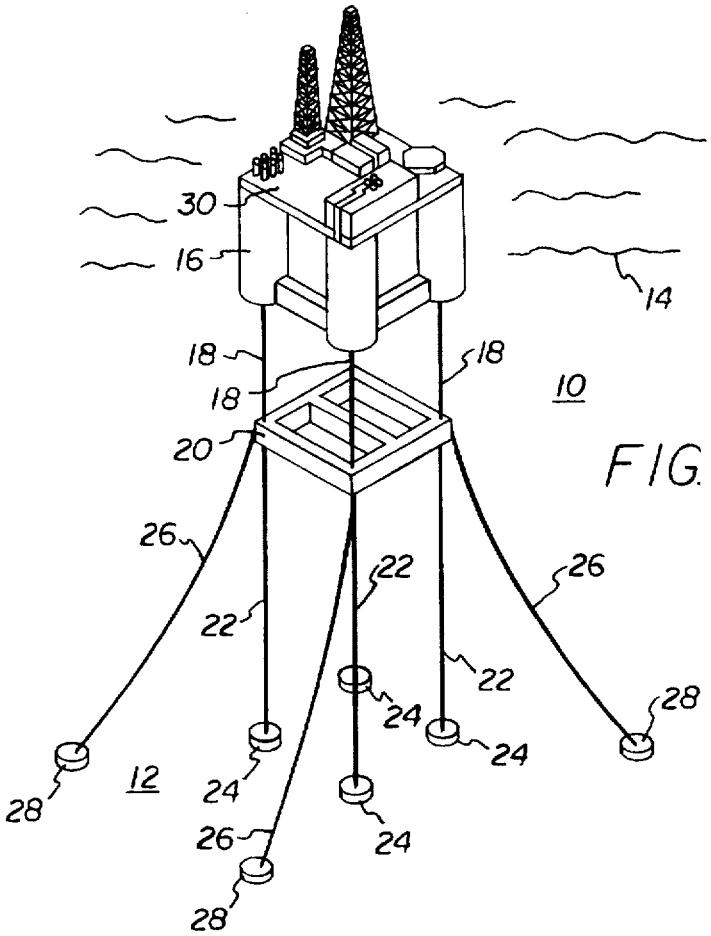
FIG. 1 illustrates one embodiment of the invention having a buoyant base for attachment to a conventional tension leg platform.

The present invention provides a significant improvement in the field of supporting a platform deck in deep water. FIG. 1 illustrates one embodiment of the invention, wherein body of water 10 is bounded by sea floor 12 and water surface 14. Tension leg vessel 16 floats at water surface 14 and is anchored with mooring tendons 18 to buoyant base 20.

Buoyant base 20 is anchored by base tendons 22 to foundation 24 which comprises piles or a drilling and production template described below. Although a single mooring tendon 18 could anchor vessel 16, two or more mooring tendons 18 are typically used to provide redundancy and additional mooring control. Mooring lines 26 can be attached between buoyant base 20 and between anchors 28 to resist lateral movement of buoyant base 20 relative to sea floor 12 caused by environmental loading forces such as currents, wind or wave action at water surface 14.

Vessel 16 can comprise any structure sufficient to support facilities such as deck 30 above water surface 14. Deck 30 provides a base for drilling or production facilities typically conducted in hydrocarbon production operations. Deck 30 can also provide a base for operations such as a helicopter landing deck, pipeline loading terminal, scientific research base, or any other use. As shown in FIG. 1, vessel 16 can comprise a concrete or steel semisubmersible used in conventional tension leg platforms. In other embodiments of the invention, the shape and form of vessel 16 can be designed to meet the design requirements unique to a particular use.

Mooring tendons 18 and base tendons 22 and 36, described hereinafter, can comprise conventional tubular pipe tendons customarily used in a conventional tension leg platform. Mooring tendons 18 can be hollow to provide buoyancy to assist in the support of mooring tendons 18. The upper end of each mooring tendon 18 is attached to vessel 16 with conventional attachment techniques, and the lower end of each mooring tendon 18 is attached to buoyant base 20. If buoyant base 20 is positioned three hundred meters below water surface 14, vessel 16 can be sized to buoyantly support vessel 16, the equipment and other facilities carried by deck 30, and mooring tendons 18. Consequently, the invention permits vessel 16 to be sized as if vessel 16 comprised a tension leg platform in three hundred meters of water, regardless of the actual depth of water 10 above foundation 24.

Buoyant base 20 independently floats within water 10 and is retained by base tendons 22 at a selected position below water surface 14. Although a single base tendon 22 could anchor buoyant base 20, the preferred embodiment of the invention uses two or more base tendons 22 to provide redundancy and improved performance characteristics. Buoyant base 20 can be contructed from concrete, steel, and other materials known in the art. In one embodiment of the invention, buoyant base 20 can be partially formed with a core of high strength syntactic foam to provide entrained gas for buoyancy without significantly reducing the compressive strength of the material. Buoyant base 20 preferably includes at least one interior chamber evacuated to provide a mechanism for selectively introducing ballast such as sea water 10 into buoyant base 20. A pump, sensor and surface controller (not shown) can cooperate to permit the movement of water 10 into and out of the interior chamber as more thoroughly described below.

Base tendons 22 are attached between foundation 24 and buoyant base 20 and are inherently tensioned by the combined buoyant force exerted upwardly by buoyant base 20 and by vessel 16. Consequently, the tension in base tendons 22 will be greater than the tension in mooring tendons 18, which are tensioned only by the buoyancy provided by vessel 16. The greater tension in base tendons 22 improves the overall dynamic performance of buoyant base 20 and vessel 16, and such tension tends to stabilize and to reduce movement of buoyant base 20. Such stabilization is further enhanced by the optional use of mooring lines 26. Consequently, the overall movement of vessel 16 in a vertical or horizontal direction will be less for the present invention than in a conventional tension leg platform installed in water of equal depth. Further, the size of vessel 16 is significantly reduced compared to a conventional tension leg platform in the same water depth.

Mooring lines 26 can be connected to buoyant base 20 to reduce lateral movement of buoyant base 20 relative to foundation 24. By placing base 20 and mooring lines 26 at a selected position below water surface 14, direct environmental loading forces caused by wind and waves do not impact base 20 and mooring lines 26. Consequently, overall performance of the system is increased.

Figure 2:
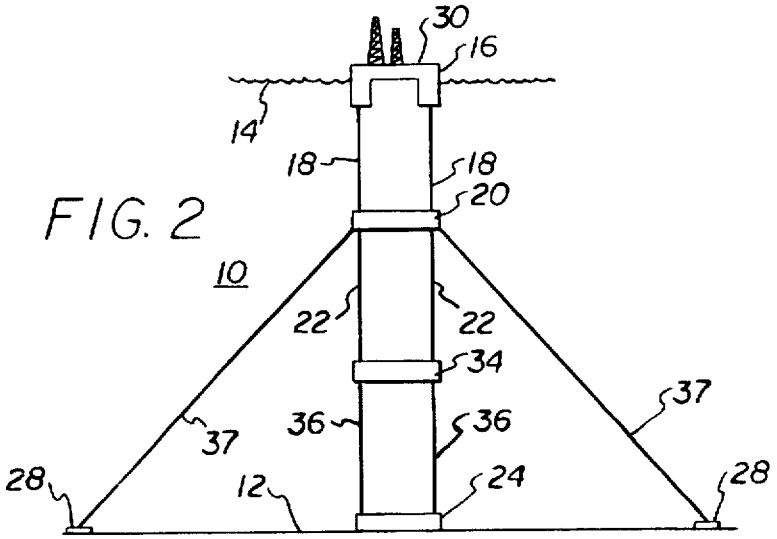
FIG. 2 illustrates the application of the invention to a further deep water application.

FIG. 2 illustrates an different embodiment of the invention wherein lower buoyant base 34 is attached to the lower ends of base tendons 22. Lower base tendons 36 are connected between lower buoyant base 34 and foundation 24 in the manner previously described for base tendons 22. Mooring lines 37 can be attached between base 20 and sea floor 12. This embodiment of the invention permits the application of the invention to water 10 of exceedingly great depths, without limitation. Additionally, such embodiment can be used to select the overall dynamic performance of vessel 16 in different environments such as in regions affected by high water currents.

FIGS. 3–10 illustrate one method for installing a buoyant base in water 10 at a depth of 1200 meters. Referring to FIG. 3, foundation 24 includes piles 38 and template 40 attached to sea floor 12. Referring to FIG. 4, buoyant base 20 is positioned above template 40, and mooring lines 26 can be attached to buoyant base 20 as shown in FIG. 5. Buoyant base 20 is lowered into water 10 by mechanically winching buoyant base 20 downwardly, or by selectively pumping water 10 into an interior chamber or chambers within buoyant base 20. By selectively introducing water into buoyant base 20 as ballast, buoyant base 20 can be transformed into a negatively buoyant structure permitting the lowering of buoyant base 20 to a selected depth below water surface 14. When the desired depth is reached as shown in FIG. 5, water 10 can be pumped out of the interior of buoyant base 20 until buoyant base 20 is neutrally buoyant.

Base tendons 22 are attached between buoyant base 20 and piles 38 as shown in FIG. 6, and water is pumped from the interior of buoyant base 20 until base tendons 22 are tensioned as shown in FIG. 7. Vessel 16 is then positioned over buoyant base 20 as shown in FIG. 8, and vertical mooring tendons 18 can be attached between vessel 16 and buoyant base 20 as illustrated in FIG. 9. When all of mooring tendons 18 are in place as shown in FIG. 10, water is pumped from the interior of vessel 16 to obtain the desired tension in tendons 18.

Buoyant base 20 creates a stable and uniform base for the deployment of vessel 16 and mooring tendons 18, thereby simplifying the design and construction of vessel 16 by creating a generic classification of tension leg platform vessels useful in different working environments. The uniformity of platform design provided by the invention permits the replacement or redeployment of vessel 16 at other locations. If desired, vessel 16 and mooring tendons 18 can be detached from buoyant base 20 and moved to dry dock for maintenance or to another working location.

The present invention provides a significant improvement over existing tension leg platform and compliant tower concepts, and will substantially reduce construction costs while increasing performance. The invention uniquely permits the application of tension leg principles in water depths greatly exceeding existing capabilities.

Although the invention has been described in terms of certain preferred embodiments, it will be apparent to those of ordinary skill in the art that modifications and improvements can be made to the inventive concepts herein without departing from the scope of the invention. The embodiments shown herein are merely illustrative of the inventive concepts and should not be interpreted as limiting the scope of the invention.

What is claimed is:

1. A buoyant tension base apparatus for anchoring a buoyant tension leg platform vessel having mooring tendons to a foundation attached to the sea floor underlying a body of water, comprising:

at least two tensionable base tendons having lower and upper ends, wherein the lower end of each said base tendon is attached to said foundation; and at least one buoyant tension base attached to the upper ends of said base tendons at a selected distance below said tension leg platform vessel and the surface of the body of water, said buoyant tension base being attachable to lower ends of said mooring tendons of said tension leg platform vessel;

said buoyant tension base being attached in tension to said foundation a selected distance below the surface of the body of water by said base tendons and said tension leg platform vessel being attached to said buoyant tension base and retained in tension a distance thereabove by said mooring tendons; whereby said base tendons are tensioned by the combined buoyant force exerted upwardly by said buoyant tension base and said buoyant tension leg platform vessel, and said mooring tendons are tensioned by said buoyant force exerted upwardly by said buoyant tension leg platform vessel.

2. An apparatus as recited in claim 1, further comprising at least two mooring lines attached to the sea floor and to said buoyant tension base to limit lateral movement of said buoyant tension base relative to the sea floor.

3. An apparatus as recited in claim 1, wherein at least four said base tendons are attached between said foundation and said buoyant tension base.

4. An apparatus as recited in claim 1, further comprising at least two sealed chambers within said buoyant tension base.

5. An apparatus as recited in claim 4, further comprising a pump engaged in fluid communication with said body of water and with said sealed chambers for controlling water flow between said body of water and said sealed chambers.

6. An apparatus as recited in claim 5, further comprising a sensor for detecting the quantity of water in each of said sealed chambers.

7. An apparatus as recited in claim 6, further comprising a control system engaged with said sensor and said pump for selectively controlling the amount of water in each of said sealed chambers.

8. An apparatus as recited in claim 1, wherein said at least one buoyant tension base comprises an upper and a lr buoyant tension base connected in vertically spaced relation;

said lower buoyant tension base attached in tension to said foundation at a selected elevation thereabove by at least two said base tendons, and said upper buoyant tension base attached in tension to said lower buoyant tension base at a selected distance below said tension leg platform vessel and the surface of the body of water; and said upper buoyant tension base is attachable to said lower ends of said mooring tendons of said tension leg platform vessel; whereby said base tendons are tensioned by the combined buoyant force exerted upwardly by said upper and said lower buoyant tension bases and said buoyant tension leg platform vessel, and said mooring tendons are tensioned by said buoyant force exerted upwardly by said buoyant tension leg platform vessel.

9. An offshore platform attachable to a sea floor foundation for supporting well operations above the water at a position above the foundation, comprising:

a buoyant offshore platform vessel having a deck above the water;

at least two tubular mooring tendons attached to said vessel and having lower ends extending downwardly from said vessel;

at least two tensionable base tendons having lower and upper ends, wherein the lower end of each said base tendon is attached to said foundation; and at least one buoyant tension base located at a selected distance below said vessel and the water surface, said buoyant tension base attached to said upper ends of said base tendons for tensioning said base tendons, and wherein said buoyant tension base is attached to said lower ends of said mooring tendons for anchoring said vessel to said buoyant tension base;

said buoyant tension base attached in tension to said foundation a selected distance below the surface of the water by said base tendons and said buoyant offshore platform vessel attached to said buoyant tension base and retained in tension a distance thereabove by said mooring tendons; whereby said base tendons are tensioned by the combined buoyant force exerted upwardly by said buoyant tension base and said buoyant offshore platform vessel, and said mooring tendons are tensioned by said buoyant force exerted upwardly by said buoyant offshore platform vessel.

10. An offshore platform as recited in claim 9, further comprising at least two mooring lines attached to the sea floor and to said buoyant tension base to limit lateral movement of said buoyant tension base relative to said sea floor foundation.

11. An offshore platform as recited in claim 9, wherein said buoyant tension base defines in interior chamber which can be selectively flooded with water to alter the buoyancy of said buoyant tension base.

12. An offshore platform as recited in claim 11, further comprising;

a pump in fluid communication with the water and with said interior chamber for controlling water flow between said interior chamber and the water, a sensor connected with said interior chamber for detecting the quantity of water in said interior chamber, and a control system engaged with said sensor and said pump for selectively controlling the amount of water in said interior chamber.

13. An offshore platform as recited in claim 9, wherein said at least one buoyant tension base comprises an upper and a lower buoyant tension base connected in vertically spaced relation;

said lower buoyant tension base attached in tension to said foundation at a selected elevation thereabove by at least two said base tendons, and said upper buoyant tension base attached in tension to said lower buoyant tension base at a selected distance below said tension leg platform vessel and the surface of the body of water; and said upper buoyant tension base is attachable to said lower ends of said mooring tendons of said tension leg platform vessel; whereby said base tendons are tensioned by the combined buoyant force exerted upwardly by said upper and said lower buoyant tension bases and said buoyant tension leg platform vessel, and said mooring tendons are tensioned by said buoyant force exerted upwardly by said buoyant tension leg platform vessel.

14. A method of anchoring the mooring tendons of a buoyant tension leg vessel to a foundation attached to the sea floor underlying a body of water, comprising the steps of:

positioning at least one buoyant tension base above said foundation;

selectively introducing ballast into said buoyant tension base to lower said buoyant tension base under the surface of said body of water;

attaching lower ends of base tendons to said foundation;

attaching upper ends of said base tendons to said buoyant tension base to retain said buoyant tension base at a selected elevation within the water; and attaching lower ends of said buoyant tension leg vessel mooring tendons to said buoyant tension base to anchor said buoyant tension leg vessel to said buoyant tension base and said foundation; whereby said buoyant tension base is attached in tension to said foundation a selected distance below the surface of the body of water by said base tendons and said tension leg vessel is attached to said buoyant tension base and retained in tension a distance thereabove by said mooring tendons; and said base tendons are tensioned by the combined buoyant force exerted upwardly by said buoyant tension base and said buoyant tension leg vessel, and said mooring tendons are tensioned by said buoyant force exerted upwardly by said buoyant tension leg vessel.

15. A method as recited in claim 14, further comprising the step of attaching mooring lines between the sea floor and said buoyant tension base to reduce lateral movement of said buoyant tension base relative to said foundation.

16. A method as recited in claim 14, wherein said step of positioning at least one buoyant tension base above said foundation comprises positioning a lower buoyant tension base above said foundation;

selectively introducing ballast into said lower buoyant tension base to lower said lower buoyant tension base under the surface of said body of water;

attaching said upper ends of said base tendons to said lower buoyant tension base to retain said lower buoyant tension base at a selected elevation within the water above said foundation;

positioning an upper buoyant tension base vertically above said lower buoyant tension base;

selectively introducing ballast into said upper buoyant tension base to lower said upper buoyant tension base under the surface of said body of water to a selected elevation above said lower tension base;

attaching lower ends of another set of base tendons to said lower tension base and attaching upper ends of said another set of base tendons to said upper buoyant tension base to retain said upper buoyant tension base at a selected elevation within the water above said lower tension base; and thereafter attaching said lower ends of said buoyant tension leg vessel mooring tendons to said upper buoyant tension base to anchor said buoyant tension leg vessel to said upper buoyant tension base; whereby said lower buoyant tension base is attached in tension to said foundation at a selected elevation thereabove by said base tendons, and said upper buoyant tension base is attached in tension to said lower buoyant tension base at a selected distance below said buoyant tension leg vessel and the surface of the body of water by said another set of base tendons; and said base tendons and said another set of base tendons are tensioned by the combined buoyant force exerted upwardly by said upper and said lower buoyant tension bases and said buoyant tension leg vessel, and said mooring tendons are tensioned by said buoyant force exerted upwardly by said buoyant tension leg vessel.

17. A method according to claim 14, wherein said at least one buoyant tension base is ballasted by moving water between the interior of said buoyant tension base and the sea water.

18. A method according to claim 14, further comprising the step of adjusting the tension in said base tendons after attachment between said at least one buoyant tension base and said foundation by moving water between the interior of said at least one buoyant tension base and the sea water.

* * * * *